US009265354B2

(12) United States Patent
Mason

(10) Patent No.: US 9,265,354 B2
(45) Date of Patent: Feb. 23, 2016

(54) MODULAR SUPPORT ELEMENT

(75) Inventor: Matteo Mason, Limena (IT)

(73) Assignee: TECHNOGEL ITALIA S.R.L., Pozzoleone (VI) (IT)

( * ) Notice: Subject to any disclaimer, the term of this patent is extended or adjusted under 35 U.S.C. 154(b) by 501 days.

(21) Appl. No.: 13/387,655

(22) PCT Filed: Jul. 29, 2009

(86) PCT No.: PCT/IB2009/053301
§ 371 (c)(1),
(2), (4) Date: Feb. 21, 2012

(87) PCT Pub. No.: WO2011/012928
PCT Pub. Date: Feb. 3, 2011

(65) Prior Publication Data

US 2012/0131752 A1 May 31, 2012

(51) Int. Cl.
*A47C 27/14* (2006.01)

(52) U.S. Cl.
CPC ..... *A47C 27/148* (2013.01); *A47C 27/146* (2013.01)

(58) Field of Classification Search
CPC .... A47C 27/20; A47C 27/148; A47C 27/144; A47C 27/15; A47C 27/146; A61G 7/05715
USPC ..... 5/652.1, 653, 654, 654.1, 655.9, 709, 5/722, 723, 724, 727, 740
See application file for complete search history.

(56) References Cited

U.S. PATENT DOCUMENTS 1,040,795 A * 10/1912 Skeffington ..... 5/613
2,858,881 A * 11/1958 Newall et al. ..... 267/145
3,742,528 A * 7/1973 Munch ..... 5/723
4,628,557 A * 12/1986 Murphy ..... 5/723
4,895,878 A * 1/1990 Jourquin et al. ..... 521/103
5,029,939 A 7/1991 Smith et al.
5,360,653 A * 11/1994 Ackley ..... 428/71
5,513,402 A * 5/1996 Schwartz ..... 5/691
(Continued)

FOREIGN PATENT DOCUMENTS

DE 3724233 C1 9/1988
DE 4041804 A1 7/1991
(Continued)

OTHER PUBLICATIONS

Patent Cooperation Treaty. "International Preliminary Report on Patentability" Oct. 2011. (15 Pages).

*Primary Examiner* — David E Sosnowski
*Assistant Examiner* — Eric Kurilla
(74) *Attorney, Agent, or Firm* — Tutunjian & Bitetto, P.C.

(57) ABSTRACT

A modular supporting element has a supporting surface for a user and includes a plurality of elastic modules, suitable for being deformed according to a direction substantially perpendicular to the supporting surface of the user. Each module has a side surface and an upper portion, wherein the modules are arranged juxtaposed to each other with the side surfaces substantially in contact or with the side surfaces at such a distance as not to prevent contact between one module and another during the elastic deformation movement. The modules have anti-friction surfaces arranged in a part of the side surface of the modules in such a way as to prevent interferences by friction between one module and another. The modular supporting element is made up of a plurality of modules with different rigidity from area to area without any appreciable influence between one module and another.

35 Claims, 19 Drawing Sheets

(56) References Cited

U.S. PATENT DOCUMENTS

| | | | | |
|---|---|---|---|---|
| 5,561,875 | A * | 10/1996 | Graebe | 5/423 |
| 5,802,646 | A | 9/1998 | Stolpmann et al. | |
| 5,870,785 | A * | 2/1999 | Hoorens | 5/652.1 |
| 5,960,497 | A * | 10/1999 | Castellino et al. | 5/730 |
| 6,092,249 | A * | 7/2000 | Kamen et al. | 5/653 |
| 6,560,803 | B2 * | 5/2003 | Zur | 5/654 |
| 7,120,956 | B1 * | 10/2006 | Liao | 5/719 |
| 7,571,504 | B2 * | 8/2009 | Kuo | 5/724 |
| 7,685,663 | B2 * | 3/2010 | Rawls-Meehan | 5/719 |
| 7,841,031 | B2 * | 11/2010 | Rawls-Meehan | 5/719 |
| 7,930,783 | B2 * | 4/2011 | Rawls-Meehan | 5/722 |
| 8,434,748 | B1 * | 5/2013 | Pearce et al. | 267/142 |
| 2003/0037377 | A1 * | 2/2003 | Kawamura et al. | 5/652 |
| 2004/0045090 | A1 * | 3/2004 | Tsai | 5/709 |
| 2006/0058408 | A1 * | 3/2006 | Sam et al. | 521/155 |
| 2007/0061978 | A1 * | 3/2007 | Losio | 5/655.5 |
| 2007/0283496 | A1 * | 12/2007 | Skripps | 5/654 |
| 2008/0034501 | A1 * | 2/2008 | Hyde et al. | 5/613 |
| 2008/0078033 | A1 * | 4/2008 | Wyatt et al. | 5/727 |
| 2008/0115288 | A1 * | 5/2008 | Poulos | 5/727 |
| 2008/0201856 | A1 * | 8/2008 | Howard | 5/690 |
| 2008/0276376 | A1 * | 11/2008 | Piccinini et al. | 5/721 |
| 2009/0038080 | A1 | 2/2009 | Grigg | |
| 2009/0126107 | A1 | 5/2009 | Kuo | |
| 2009/0205138 | A1 * | 8/2009 | Chen et al. | 5/691 |
| 2011/0004998 | A1 * | 1/2011 | Losio | 5/699 |
| 2011/0126356 | A1 * | 6/2011 | Steppat et al. | 5/727 |
| 2011/0179580 | A1 * | 7/2011 | Wieland | 5/719 |
| 2012/0192358 | A1 * | 8/2012 | Katan | 5/726 |

FOREIGN PATENT DOCUMENTS

| | | | | |
|---|---|---|---|---|
| EP | 0208130 | A2 | 1/1987 | |
| EP | 0414586 | A1 | 2/1991 | |
| EP | 606892 | A1 * | 7/1994 | A47C 27/14 |
| EP | 1854379 | A1 | 11/2007 | |
| EP | 2095745 | A1 * | 9/2009 | A47C 27/14 |
| WO | WO81/02384 | | 9/1981 | |
| WO | WO97/45038 | | 12/1997 | |
| WO | WO2005/099520 | A1 | 10/2005 | |
| WO | WO 2009107092 | A2 * | 9/2009 | A47C 27/14 |

* cited by examiner

MODULAR SUPPORT ELEMENT

TECHNICAL FIELD OF THE INVENTION

The present invention relates to a modular supporting element for harmonized support in a way adaptable to the body of a person or parts thereof, such as, e.g., a mattress, a cushion, a sitting surface of a chair, of an armchair, a saddle for vehicles and the like.

BACKGROUND ART

Mattresses and similar supporting elements are known which are composed of a plurality of modular elements, generally identical with each other, assembled so as to make up a mattress, a cushion or another supporting element.

Examples of embodiments of such products are known, e.g., from WO-81/02384, EP-0208130, DE-3724233, EP1854379, EP-0414586, WO-2005/099520, US-2009/0038080. The mattresses or the supporting elements described in these documents generally comprise a supporting base or an element suitable for housing the modular elements and a protective wrapping or a casing for containing all the elements.

The main advantages of such embodiments lie in the smaller overall dimensions, when they are still not assembled, which ensures easier storage, transport and the possibility for the end user to make the mattress or, generally, the above supporting element, independently.

Furthermore, the modular elements making up the supporting elements of known type can be composed of deformable and elastic elements with various characteristics and with various dimensions so as to adapt to various users and also to the different supporting areas of the user, e.g., head, back, legs, etc.

Consequently a mattress, or a supporting element, made from these modular elements, allows adapting the shape of the supporting surface to people's bodies, according to the conformation and specific requirements of the people themselves.

A drawback of the known type embodiments derives from the presence of a continuous upper sheet of material of polyurethane foam, latex, felt type or the like, used to provide, a uniform surface for the mattress, or for the supporting element when this is assembled. Because of this sheet, the localized adaptation which the single modular elements ought to provide is considerably reduced, since the upper continuity of the sheet itself generates a masking effect of the different elastic capacities, of the carrying capacity and of the profile adaptation of the individual modular elements.

In the event of the upper sheet not being present, the modular elements, being at a certain distance from each other, cannot provide a continuous support for the user, creating an unpleasant feeling of discomfort.

To overcome this drawback, the manufacturers make modular elements with a height below that of the mattress, compensating the lower height with a block of foam or another element used as a base.

In the event of the modular elements, of the polyurethane foam type, being completely juxtaposed with each other, as for example in WO-81/02384, the different elastic and profile adaptation capacities of the single modular elements are hindered by the friction generated between one element and another, and after use, the surface on which the user rests becomes irregular.

SUMMARY OF THE INVENTION

One object of the present invention is to upgrade the state of the art.

Another object of the present invention is to make a modular supporting element with upgraded elastic, cushioning and more adaptable characteristics.

Another object of the present invention is to make a modular supporting element made up of a plurality of modules with different rigidity from area to area without there being any appreciable influence between one module and another.

Another object of the present invention is to make a modular element made up of modules with height equal to 100% of the thickness of the product as a whole, with the only exception of a possible covering sheet.

Another object of the present invention is to make a modular supporting element with heat adjustment characteristics and upgraded possibilities of transpiration.

Yet another object of the present invention is to develop a modular supporting element that is easy to assemble by the end user.

These and other objects are all achieved by the modular supporting element, according to one or more of the attached claims.

BRIEF DESCRIPTION OF THE DRAWINGS

These as well as further advantages will be better understood by any expert in the field from the following description and annexed drawings, given as non-limitative examples, wherein:

FIG. 37 shows a group of modules, as per the FIG. 36, arranged so as to form a supporting element according to the present invention.

DETAILED DESCRIPTION OF PREFERRED EMBODIMENTS

With reference to the illustrations, by 1 is indicated a modular supporting element in its entirety which during the course of the present description shall be exemplified with a mattress, but which can comprise other supporting elements, such as cushions, seating surfaces of a chair, of an armchair, a saddle for vehicles and the like without because of this losing in general details and in any case always within the scope of the present invention.

The modular supporting element 1 according to the present invention comprises a plurality of modules 3, 4, 6, in which each module has at least a side surface and an upper portion 5, and the modules 3, 4, 6 are arranged juxtaposed the one to the other with the side surfaces substantially in contact.

Figure 1:
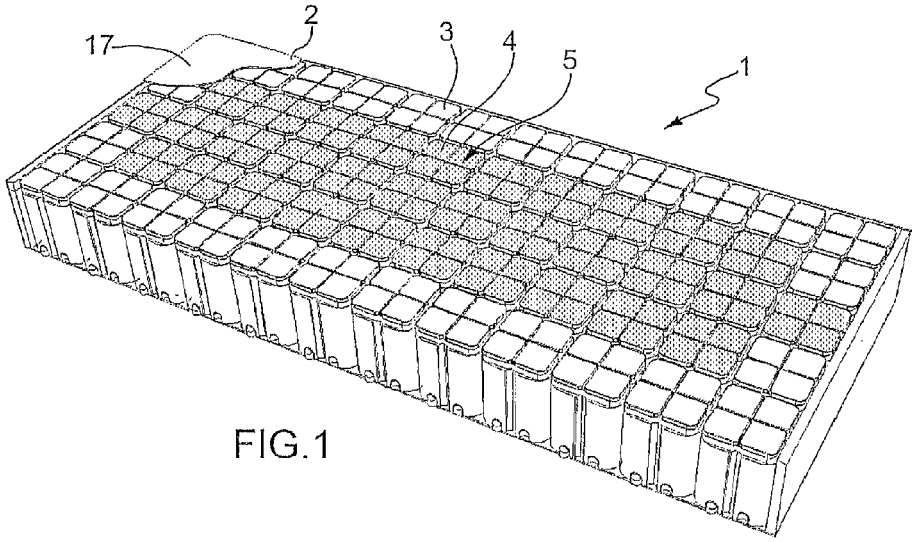
FIG. 1 is a perspective view from above, with some parts removed, of a supporting element, in the form of a mattress made with a plurality of supporting modules, according to the present invention.

The FIG. 1 shows a mattress 2 comprising a plurality of modules 3, 4, generally shaped like a prism or a parallelepiped. In this version of the invention, the modules 3 have characteristics different to those of the modules 4, and in particular, the modules 4 have capacity and heat transmission characteristics particularly suitable for supporting the body of the user, because it is generally in that area of the mattress.

According to a non-limitative example, the modules 4 comprise an upper portion 5 made in material of the gel type, and in particular of polyurethane gel. The modules 3 on the other hand can be made of a single elastic material, e.g., a mold or block polyurethane foam, with compression resistance values at 40% preferably included between 0.5–10 kPa and even more preferably included between 1.0–3.5 kPa, such values being measured according to the ISO 3386 standard. In this way, greater savings are obtained while still maintaining excellent characteristics of comfort and/or using this solution in the perimeter areas.

Figure 2:
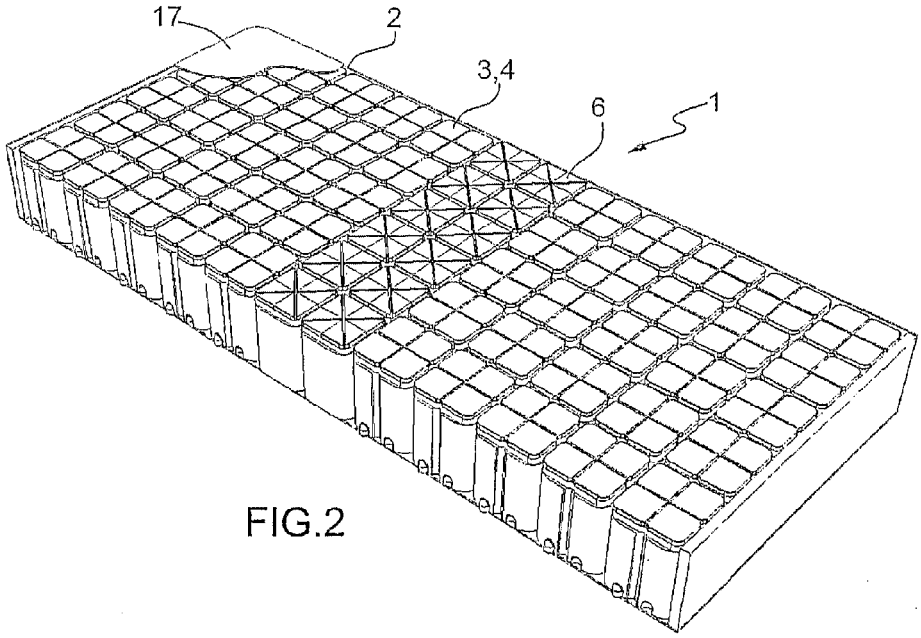
FIG. 2 is a perspective view of another version of the supporting element of FIG. 1.

The FIG. 2 shows another version of a mattress, that comprises a number of modules 6, positioned for example in the lumbar region, with different geometries that allow obtaining specific surface deformations in favor of the user.

Figure 2A:
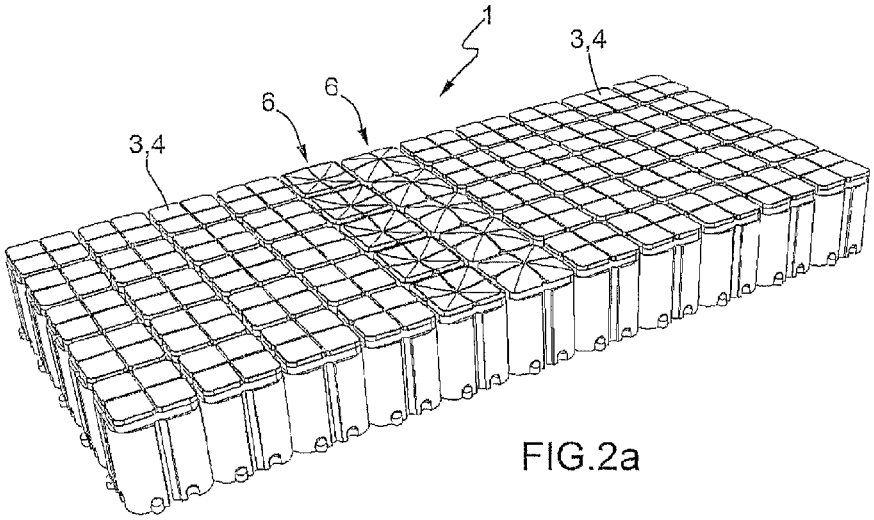
FIG. 2*a* is a perspective view of still another version of the supporting element of FIGS. 1 and 2.

The FIG. 2*a* shows a further version of mattress comprising a number of modules 6 with non-planar supporting surfaces for the user, e.g., concave and convex, to obtain other supporting effects in the lumbar region and/or other supporting portions of the user.

Figure 14:
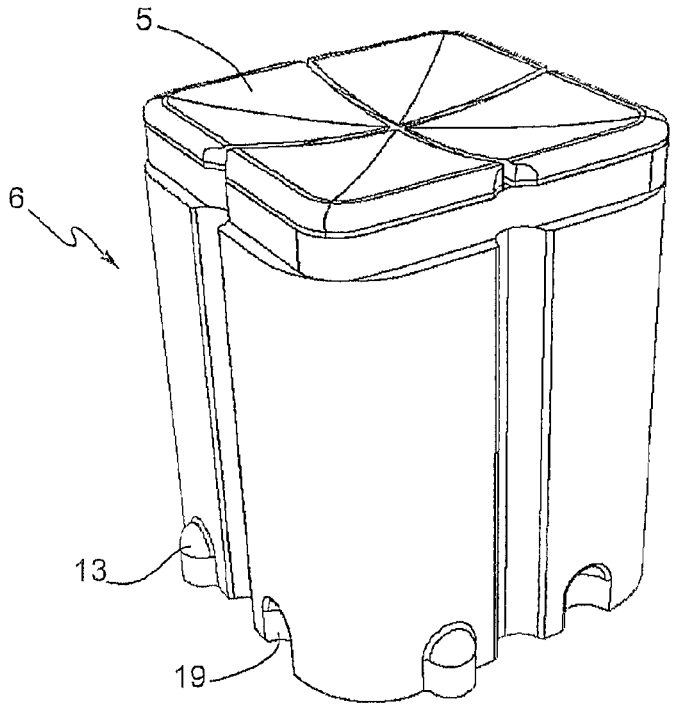
FIG. 14 shows another version of a module which has an upper concave portion.
Figure 15:
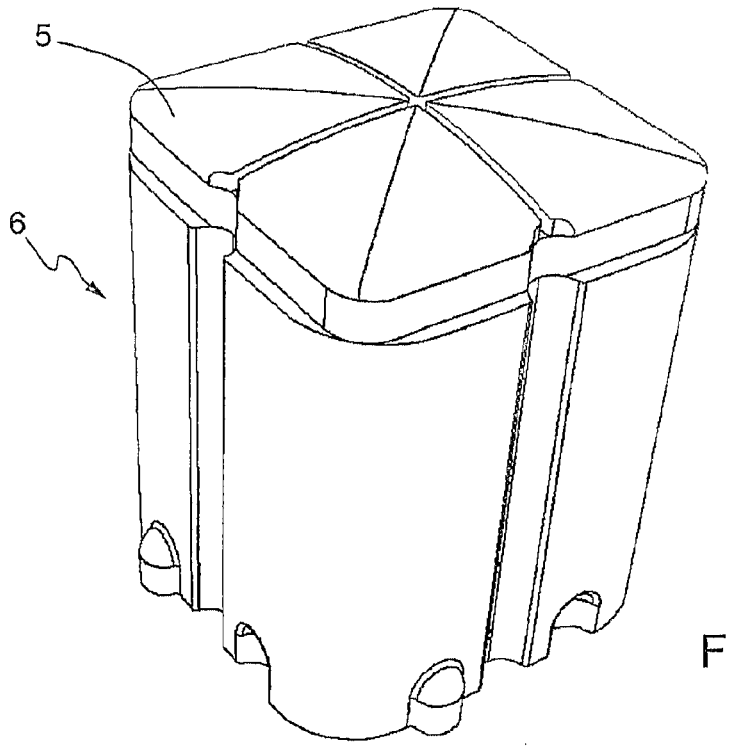
FIG. 15 shows still another version of a module which has an upper convex portion.

Further details of the shapes of the upper portions 5 of the modules 6 are shown in the FIGS. 14 and 15: in the FIG. 14 the module 6 has a concave upper portion 5, while in the FIG. 15 the upper portion 5 is convex. Generally speaking, the supporting element 1 according to the present invention can comprise any one combination of modules with different characteristics according to the user's requirements.

For example, the mattress 2 can comprise various modules for the different areas of the user's body, i.e., it is possible to have specific modules for the lumbar region, for the leg region, for the torso region, for the head region, etc. Generally speaking, and according to what is described below and illustrated in greater detail in the FIGS. 19-32, the modules 3, 4 and 6 can be made from single-density or multi-density material, e.g., viscoelastic foam and flexible foam materials or gel and flexible foam, or multi-density flexible foams, or also a combination of all the above-mentioned materials and also others: gel, viscoelastic foam, flexible foam, etc. According to what is shown in the FIGS. 3 and 4, the modules 3, 4, 6 can be fastened and juxtaposed the one to the other by means of unification means 7.

Figure 12:
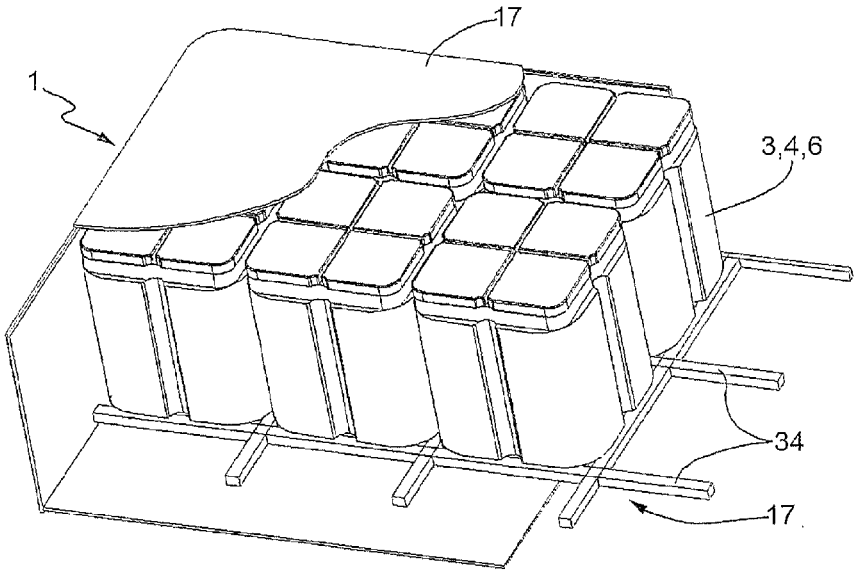
FIGS. 12 and 13 show two perspective views from above of two further versions of the supporting element according to the present invention.
Figure 13:
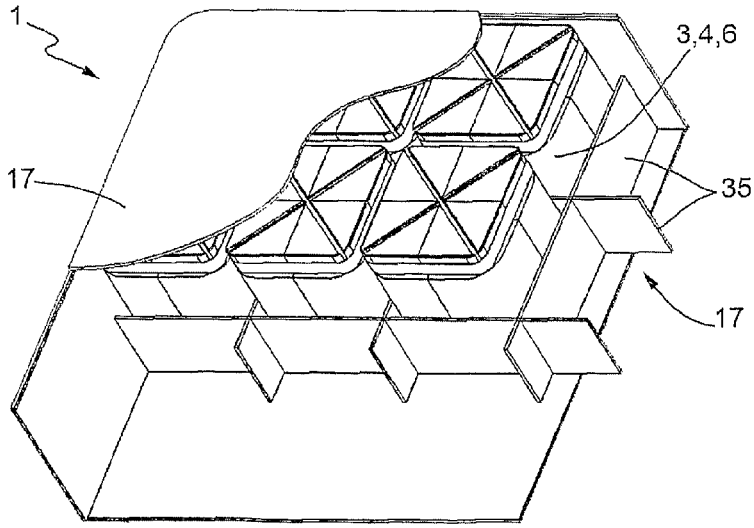

For example, such means can be made by means of plates 7, that can be made of plastic material, fabric and the like. The plates 7 also have pegs 8 suitable for fitting in respective housings 9 provided in elements 10 of the base of the modules 3, 4, 6, or other equivalent means such as screws, automatic studs, zip fasteners, hook and loop (e.g., Velcro®), etc. According to what is shown in the FIGS. 12 and 13 other unification systems or means can be integrated in the containment hood and can also be horizontal wall meshes of the grille type 34 (FIG. 12) or vertical wall meshes of the pigeon-hole type 35 (FIG. 13).

Figure 6:
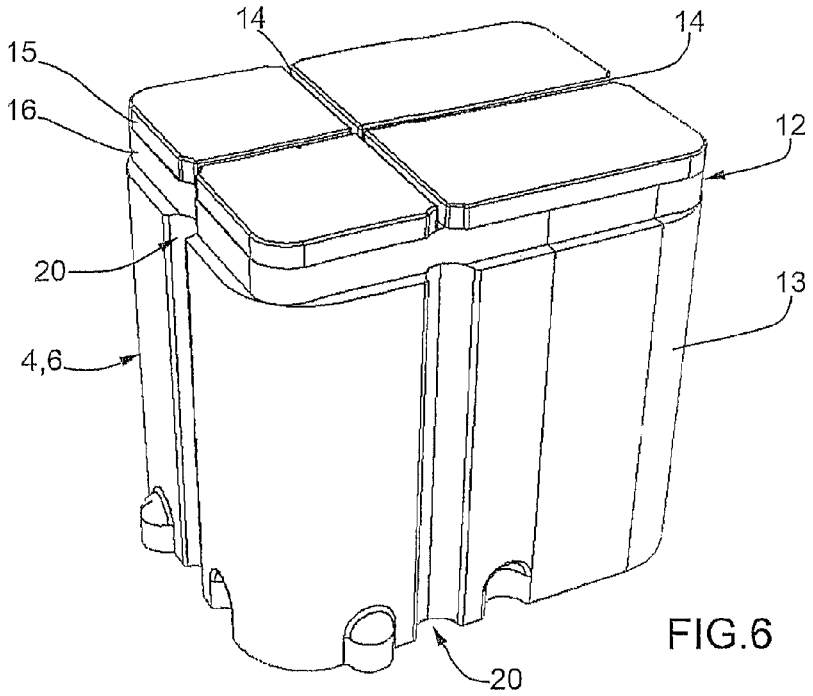
FIG. 6 is a perspective view from above of another version of a module for making up a supporting element according to the present invention.
Figure 7:
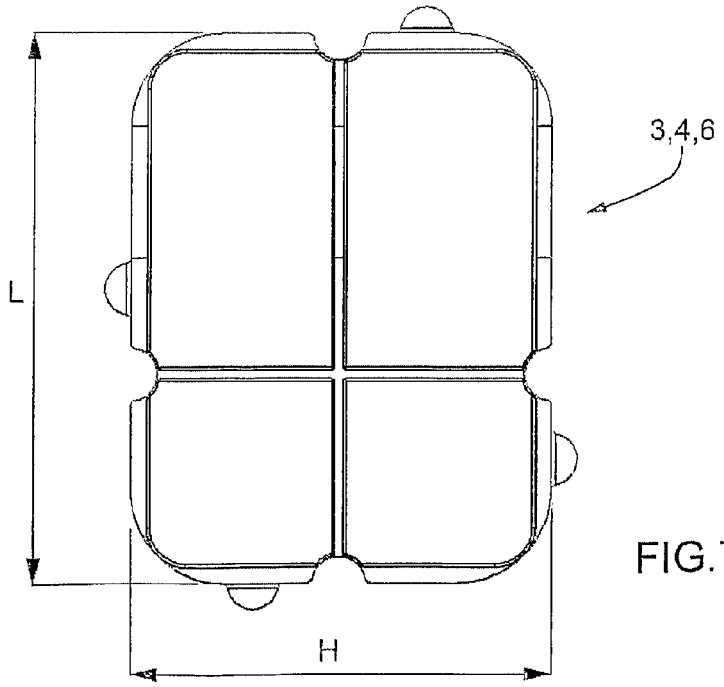
FIG. 7 is a plan view from above of the supporting element of FIG. 6.
Figure 8:
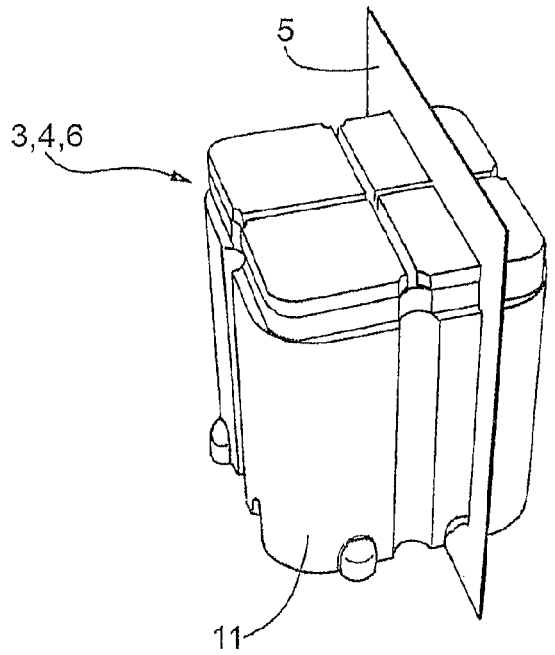
FIG. 8 is a perspective view from above of a module for making up a supporting element according to the present invention with the indication of a section plane S.

According to what is better shown in the FIGS. 6 and 7, the unification means 7 can be absent and, to maintain the position the modules 3, 4, 6, complementary geometry means are present, e.g., complementary protrusions 18 and recesses 19 which determine a self-assembly of the modules themselves.

According to still other versions of the present invention, the modules 3, 4, 6 can remain juxtaposed the one to the other thanks to intrinsically stable geometries of the modular element. It has in fact been determined that the modules with a ratio between base surface and height (S/h) preferably greater than 5, and even more preferably greater than 8, are individually stable and do not need unification means 7 to remain juxtaposed the, one to the other.

By way of a non-limitative example, a number of dimensions are given of intrinsically stable, modules: each module can have a square base with a 16 cm side and 20 cm height, or a square base with a 13 cm side and 10 cm height.

It should be noted that thanks to the flexibility and the thinness of the plates 7, or thanks to the absence of any means of connection between one module and another, the entire mattress 2 has a flexibility such as to also be usable for reclining beds.

An important feature of the present invention is the presence of anti-friction means 11 arranged at least on part of the sides of the modules 3, 4, 6; in some versions the above anti-friction means 11 can be cohesive with the modules, in other versions the anti-friction means 11 are not cohesive with the modules and can form part of the modules themselves or can be comprised in other parts of the supporting element, e.g., they can be included in a module containment hood, or, otherwise, be completely independent.

With reference to what is shown in the FIGS. 8-11, the anti-friction means 11 can be arranged on the entire surface of the module 3, 4, 6 (FIG. 9), on the upper surface and partially or completely on the side surface (FIG. 10), or partially or completely on the side surface (FIG. 11) of the module 3, 4, 6.

Because some of the anti-friction means 11 forming part of the modules, both in the cohesive version and in the non-cohesive version to the modules, could prevent the flow of air, at least the base of the module 3, 4, 6 must be left free, partially or totally, to allow the free deformation of the module and the flow of air inside the module itself.

The anti-friction means 11 can comprise a film, a fabric, a non-woven fabric, a coating or a material, of the polyurethane (PU) type or ethylene-vinyl acetate (EVA) type, of the self-skin foam type, i.e., plastic foam material that generates a film on its outside surface so as not to determine friction when a module deforms vertically and moves with respect to the adjacent modules. Other anti-friction means can also be obtained with modules comprising thermoplastic materials, silicones, microcellular polyurethanes, which produce slipping between the surfaces of the modules.

In this way, we have the complete freedom of movement of a module with respect to the other adjacent modules, i.e., the elasticity of the material of one module can return the module itself to its initial position, when the compression force is removed, without the presence of the walls of the other modules being able to prevent this action.

Thanks to the anti-friction means, the modules can be arranged juxtaposed the one to the other without any empty intermediate spaces of a specific dimension between one module and the other.

The intermediate empty spaces between one module and the other would otherwise be required in case of modules, for example, made of polyurethane foam, or other material able to create friction, at least in the central parts to prevent contact between the modules during the deformation movement and therefore to prevent friction between the modules.

In fact, in the embodiments of known type, large empty spaces are necessary between one module and another to leave a free, deformation movement for each module, in particular the movement according to the vertical direction of elasticity and deformability of each module. On the other hand, these empty spaces also cause the vertical instability of the modules and/or require the modules to be of lower height with respect to the finished product, i.e., the thickness of the mattress for example.

Furthermore, the presence of empty spaces between one module and another also requires the use of sheet parts for the surface turned towards the user to prevent him/her penetrating the empty spaces, or else it is necessary to adopt modules with low-deformability foam, i.e., rather rigid, and therefore less comfortable for the user. Thanks to anti-friction means, the modules can always therefore be extended along the entire height of the product and can also have different heights and surfaces so as to best optimize the final ergonomics and cater for all the dimensions required by the market.

The FIGS. 6 and 7 show a module with rectangular base dimensions L and H which, in the mattresses for example, allows correctly positioning the modules 6 for the lumbar area, with different elasticity and carrying capacity, according to the different heights and sizes of the user.

Figure 16:
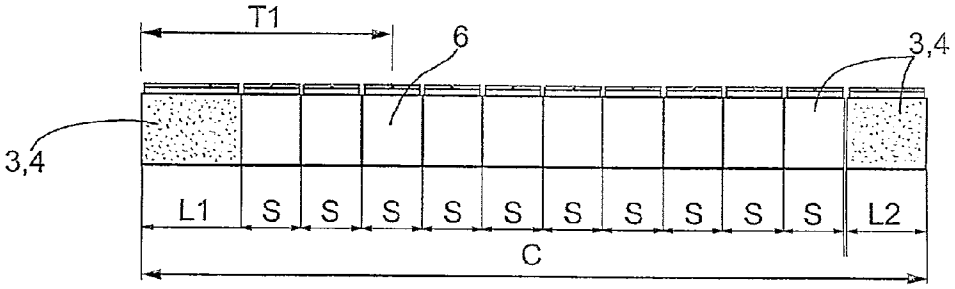
FIGS. 16-18 show some examples of applications of modules with a rectangular base, on the edges of the supporting element, so as to obtain different positions of the modules for the lumbar region.
Figure 17:
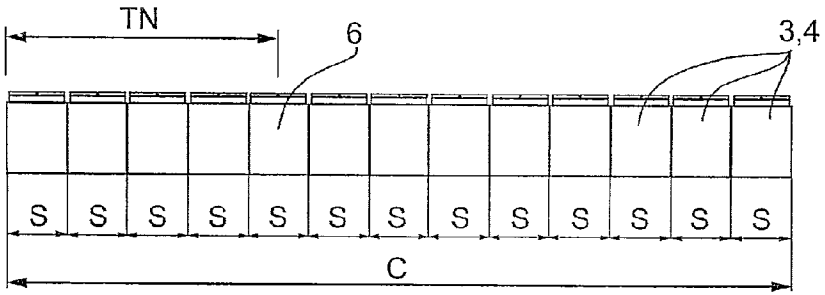
Figure 18:
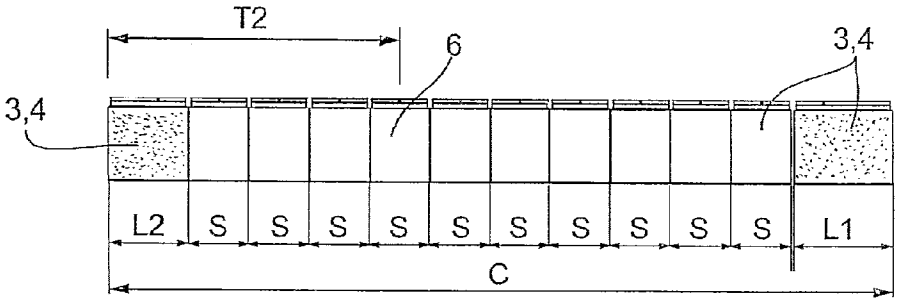

The FIGS. 16-18 show some examples of application of these modules with a rectangular base, and/or with different geometry, which permit obtaining different positions of the lumbar area for three different user sizes, in particular in this example a mattress is shown with total length C.

The FIG. 16 shows a first version of the mattress according to the present invention, having one or more rows of modules for lumbar support in the position suitable for people of small size.

The modules are placed at a distance T1 from the upper edge (on the left in the illustration) of the supporting element. To obtain the correct position of the modules to support the lumbar region, besides the normal modules 3, 4, 6 of length S, a row of modules is present with dimension L1 located in the upper perimeter area of the supporting element, and a row of modules with dimension L2 located in the lower perimeter area (on the right in the illustration) of the supporting element.

The FIG. 17 shows a second version of the supporting element according to the present invention, having one or more rows of modules for lumbar support in the position suitable for people of medium size. Such modules are placed at a distance TN from the upper edge (on the left in the illustration) of the supporting element.

In this case, the normal modules 3, 4, 6 of length S are already ready to obtain the row or the rows of modules for lumbar support at the correct distance TN from the upper edge. Finally, the FIG. 18 shows a third version of the supporting element according to the invention, which has one or more rows of modules for lumbar support in the position suitable for people of large size. Such modules are placed at a distance T2 from the upper edge (on the left in the illustration) of the supporting element.

To obtain the position of the modules for lumbar support at the correct distance T2, besides the normal modules 3, 4, 6 of length 5, there is a row of modules of length L2 placed in the upper perimeter area of the supporting element, and a row of modules of length L1 placed in the lower perimeter area (on the right in the illustration) of the supporting element.

It must be noticed that, according to the examples shown in the FIGS. 16 and 18, by switching over the position of the modules of length L1 and L2 of the upper perimeter area to the lower perimeter area, and vice versa, the right positioning can be obtained of the row or the rows of the modules for lumbar support for the small size and the large size.

These are simply examples of embodiments of three positions for the lumbar support modules, but naturally a larger number of positions can be obtained with other modules of still different dimensions, to be positioned in the upper perimeter area and lower perimeter area of the mattress.

The modules can naturally have deflections differentiated according to the support they have to provide in each area, and thanks to the anti-friction means the characteristics of each module are not affected by those of the adjacent modules.

For example, for offsetting any measurements of the finished product, i.e., of the mattress, the cushion, etc., the modules 3 of the perimeter areas (FIG. 1) can be made of block foam, less expensive, without negatively impacting the possibility of movement of the other adjacent modules 4. Alternatively, modules with different geometry can be used, e.g., different length, which in any case lead to the obtaining of the required final measurement, e.g., according to what is shown in detail in the FIGS. 16-18.

The modules 3, 4, 6 can comprise a summital part 12 and a lower body 13. The modules 3, 4, 6 can have three-dimensional geometries, grooves, etc., and vertical channels 20 connected to the horizontal channels 14 to favor air circulation.

Figure 4:
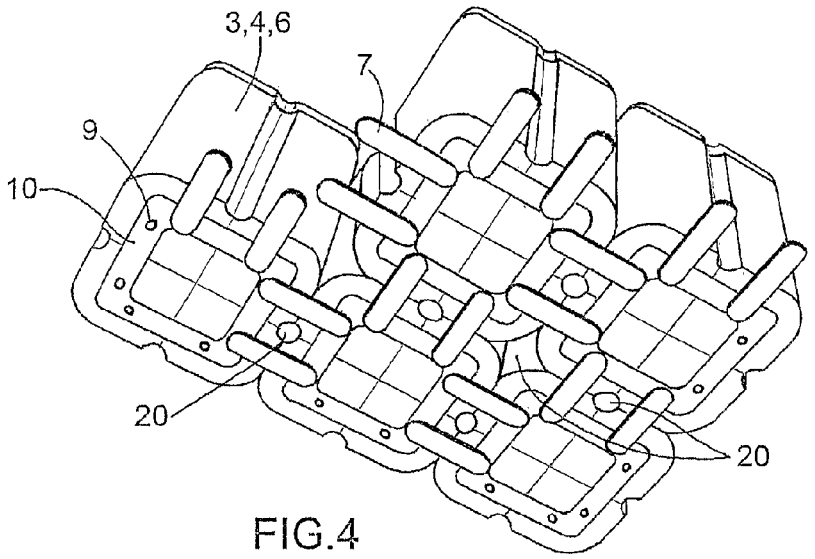
FIG. 4 is a perspective view from below of the modules of FIG. 3.
Figure 5:
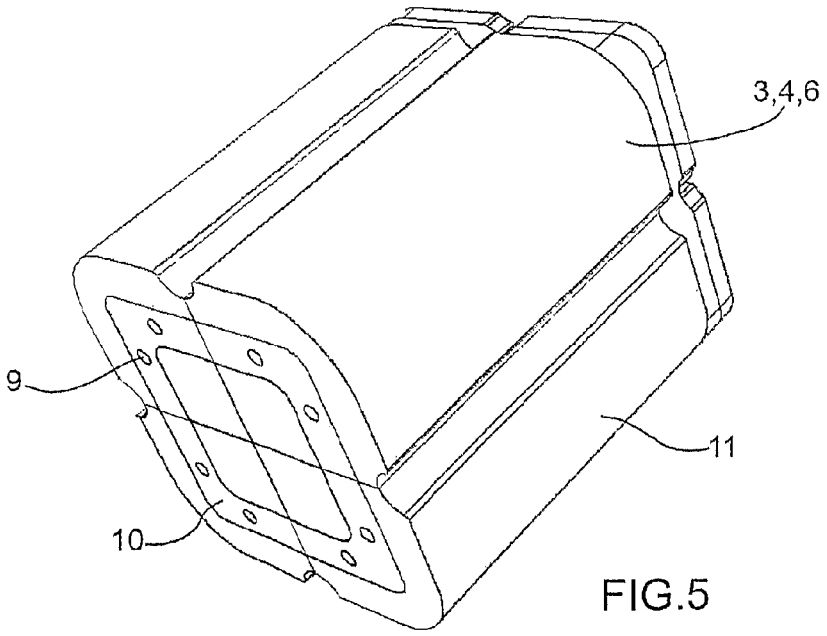
FIG. 5 is a perspective view from below of a module of FIGS. 3 and 4.

In particular, in the upper part turned towards the user, the horizontal channels 14 are obtained with grooves on the summital part 12 of the modules and/or with a summital part of transversal surface lower than the transversal surface of the lower body 13 (FIG. 6) so as to create the above channels 14, while, the vertical channels 20 are obtained by making half vertical holes and/or large-radius connections on the corners of the modules (FIG. 4).

Figure 36:
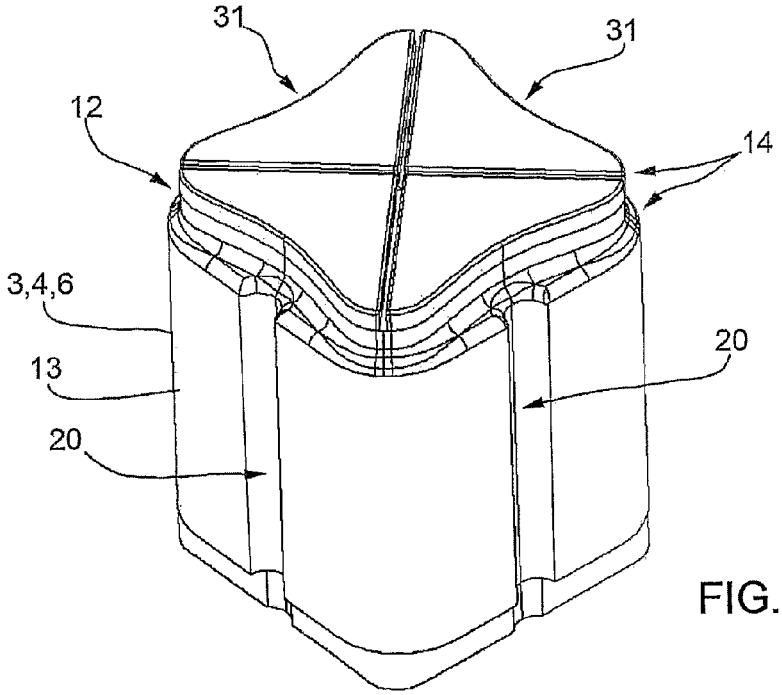
FIGS. 36 and 37 show still another version of the module which can make up a supporting element according to the present invention.
Figure 37:
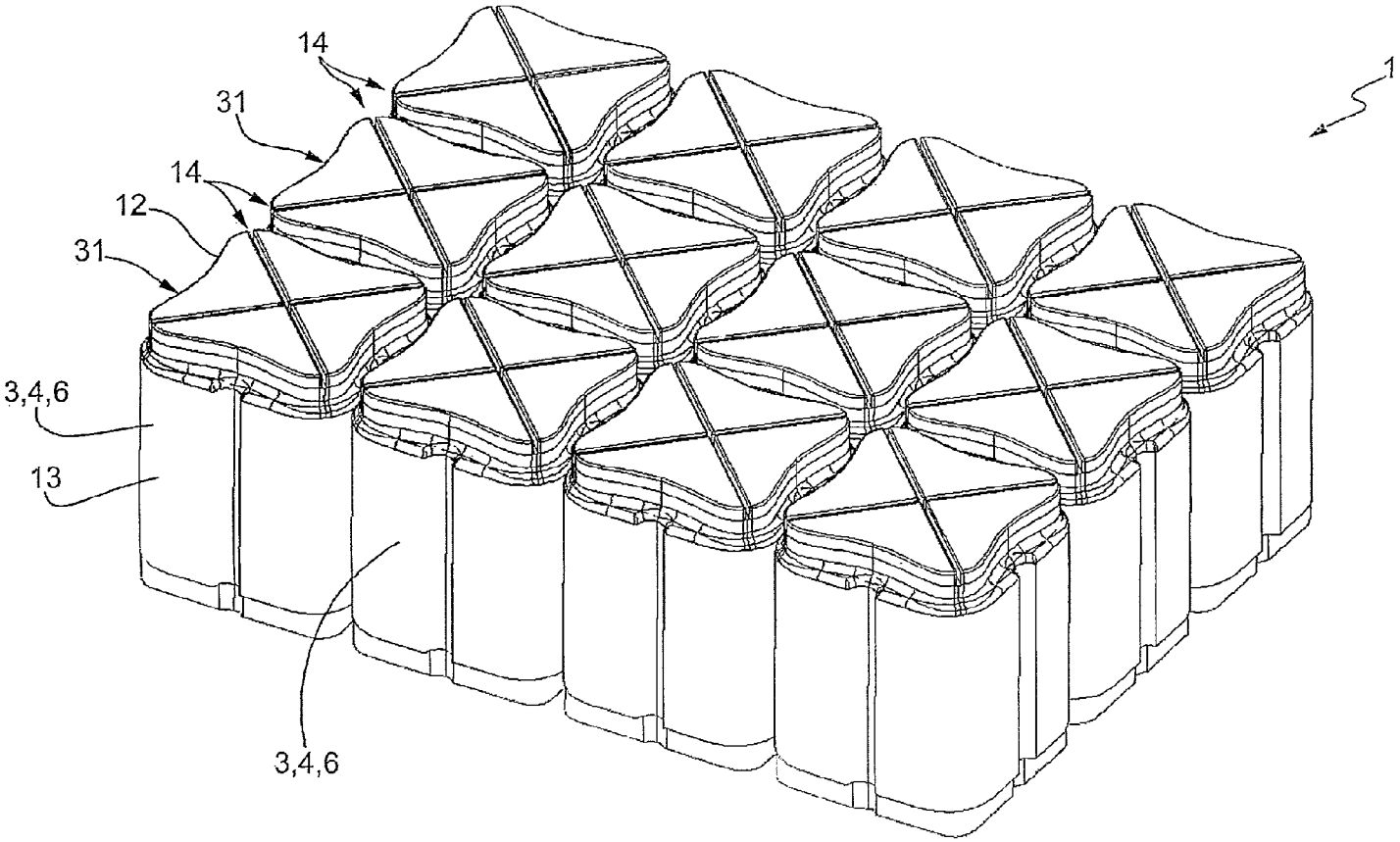

According to the version shown in the FIGS. 36 and 37, the modules 3, 4, 6 have even larger channels 14. These channels are obtained with summital parts 12 having, both a smaller transversal surface than the transversal surface of the lower body 13, and a drawing of the surface with large arched areas 31 in the intermediate part of each side.

For example, in the case of a summital part 12 with four sides like that shown in the FIGS. 36, 37, the summital part 12 has an approximately four-leaved shape.

Furthermore, according to a further version of the invention not shown here, the modules 3, 4, 6 can comprise two opposite summital parts, i.e., the modules have an upside-down symmetry thereby making it possible to make supporting elements 1 with two opposite surfaces of use.

Figure 3:
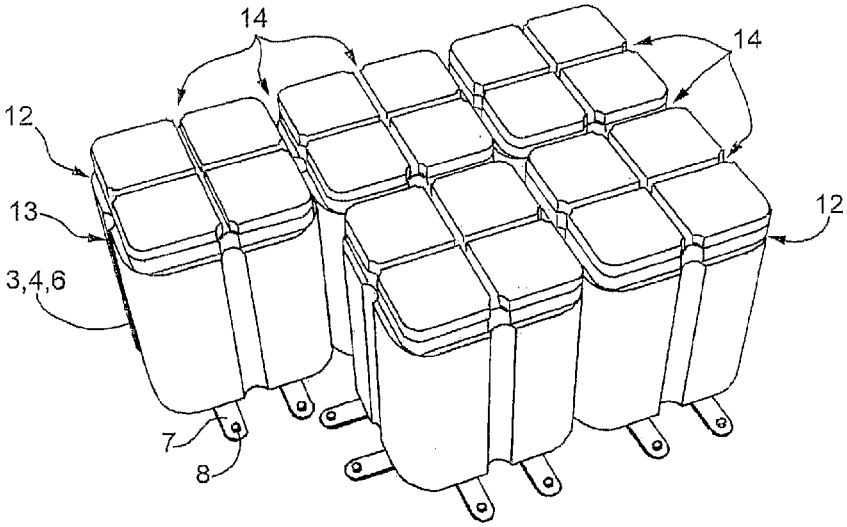
FIG. 3 is a perspective view from above of some modules of a supporting element according to the present invention.

According to the versions of the invention better shown in the FIGS. 3 and 6, the modules 3, 4, 6 comprise an upper layer 15 in gel, an intermediate layer 16 in viscoelastic foam, or another type of foam with different elasticity and carrying-capacity characteristics, and finally a body 13 in flexible foam.

The lower body 13, as in the case of the module 3 already mentioned above, can comprise a part in mold or block polyurethane foam, with 40% compression resistance values, preferably between 0.5–10 kPa and even more preferably between 1.0–3.5 kPa, such values being measured according to the ISO 3386 standard.

The FIGS. 19-26 and 33-35 show other versions of the modules 4, 6 making up the supporting element according to the present invention.

Figure 19:
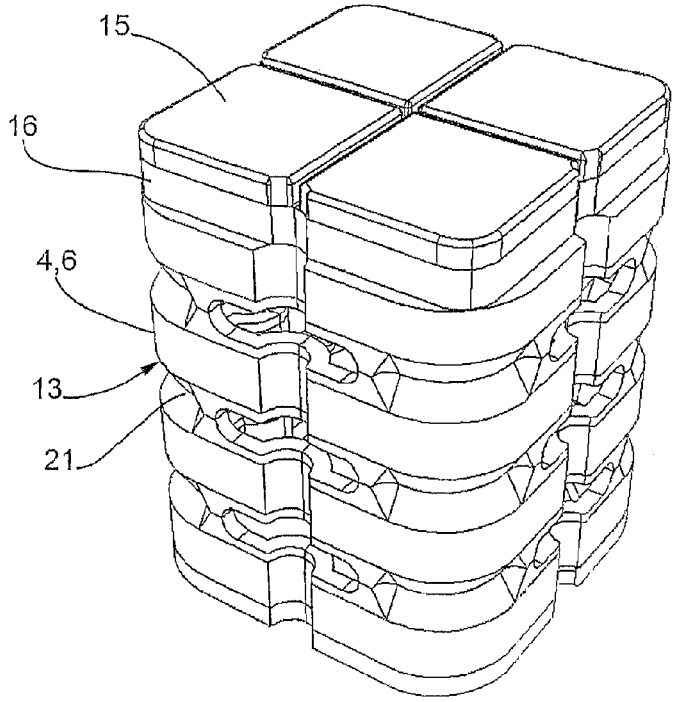
FIGS. 19-35 show other versions of the modules which can make up a supporting element according to the present invention.
Figure 20:
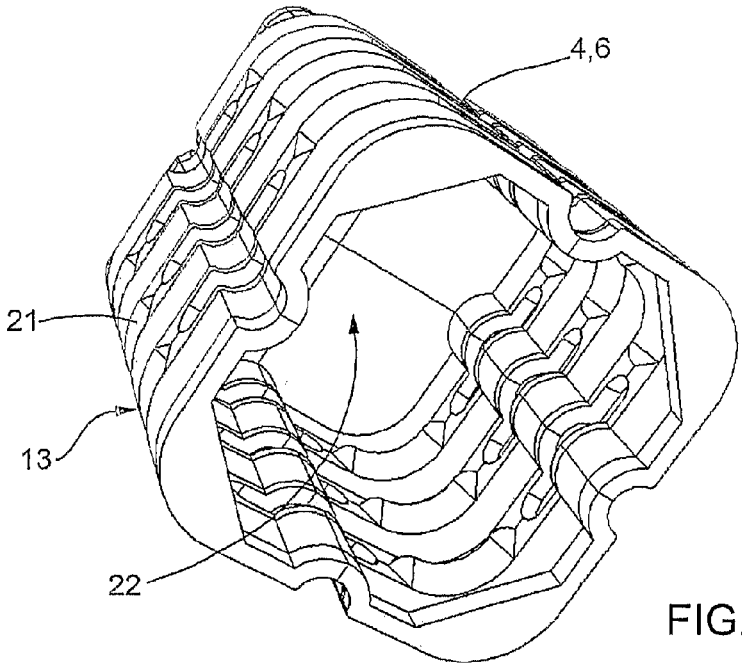

In particular, in the module 4, 6 of the FIGS. 19, 20 the elasticity and the deformability is obtained with a body 13, not in foam, but comprising a non-expanded plastic material, of the type indicated by the code TPE (thermoplastic elastomer), silicone, compact elastomeric polyurethane (PU), or slightly expanded, of the microcellular polyurethane type, foam EVA (ethyl vinyl acetate), which can be provided with openings 21 and/or at least an inner cavity 22 (FIG. 20).

Figure 21:
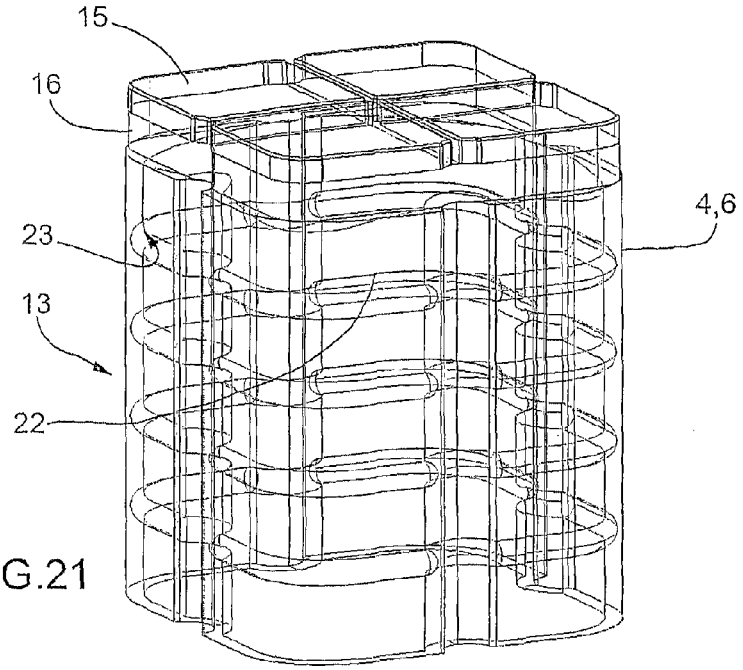
Figure 22:
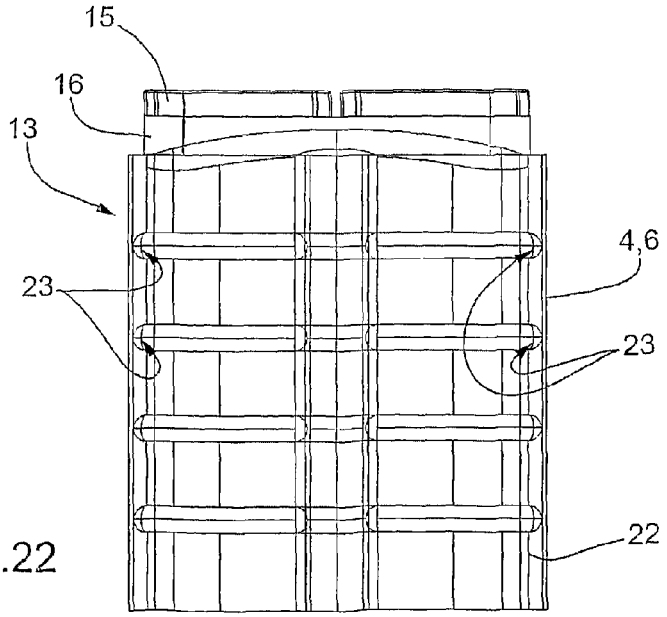

In the module 4, 6 of the FIGS. 21, 22, the body 13, which can also be made of thermoplastic material in this case as well, has a cavity 22 and/or grooves 23.

Both the openings 21, and the grooves 23 permit greater, localized, deformability of the body 13 so as to obtain the desired elasticity and carrying-capacity characteristics of the module 4, 6. In the FIGS. 33-35, the module 4, 6 is substantially similar to that of the FIGS. 19, 20, but could also be derived from the module shown in the FIGS. 21, 22. In this case, the body 13, which can be made in thermoplastic material, has at least a spring 32 fitted in the cavity 22 and connected to the body 13 by means of means of connection 33, which permits a joint deformation movement between the body 13 and the spring 32.

In a version of the module body not shown here, the spring 32 can also be completely or partially drowned in the material of the body itself.

Thanks to the presence of the spring 32, it is therefore possible to control and regulate the deformability of the body 13 in an even more effective way.

The spring 32 can be of the helical type, or of another shape suitable for having a deformation in an axial direction, e.g., superimposed Belleville washers can be used (not shown). The springs can be made of metal, e.g., music wire, or of other non-metal elastic material, e.g., of composite material such as carbon fibers with epoxy resins, Kevlar™, etc.

Figure 23:
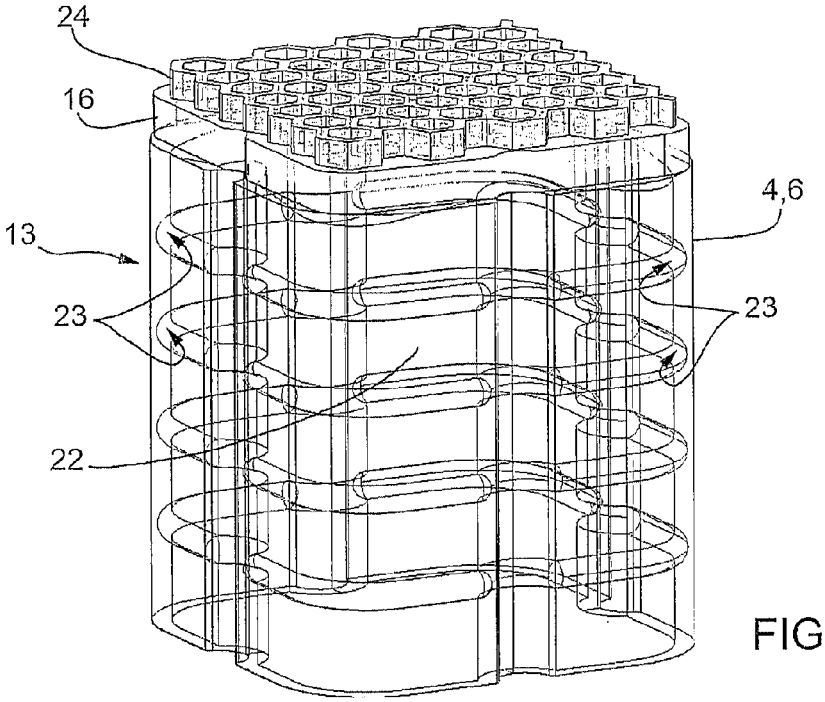
Figure 24:
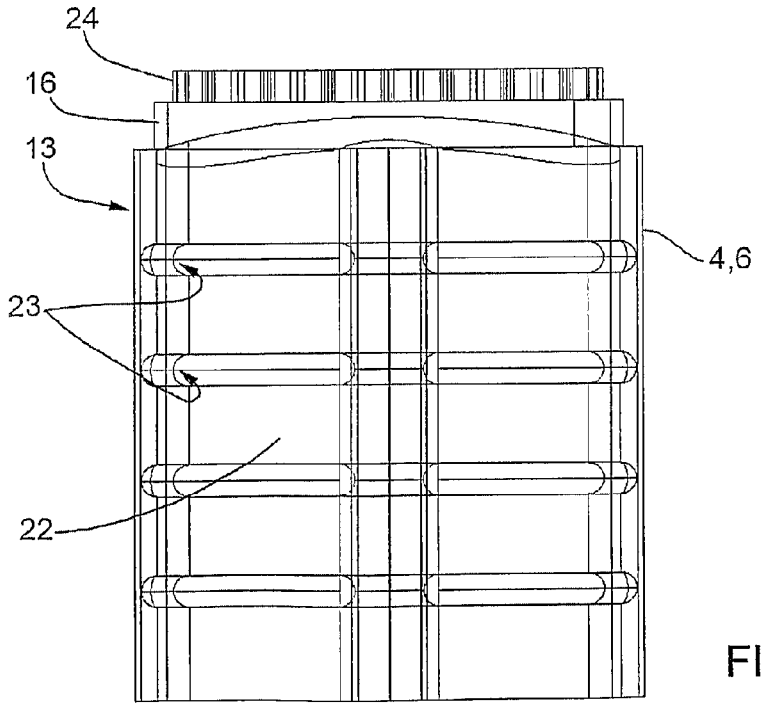

The FIGS. 23, 24 show another version of the module 4, 6, substantially similar to that of the FIGS. 21, 22 inasmuch as comprising the same body 13 and the foam layer 16, while an upper layer 24 is present comprising a honeycomb structure, made for example from a gel, or with other adequate material, e.g., TPE (Thermoplastic elastomers).

The honeycomb structure of the upper layer 24 is just one example of open structure suitable for obtaining a control of the elasticity and carrying-capacity characteristics, and naturally other geometries can also be used based on polygonal geometric figures.

Figure 26:
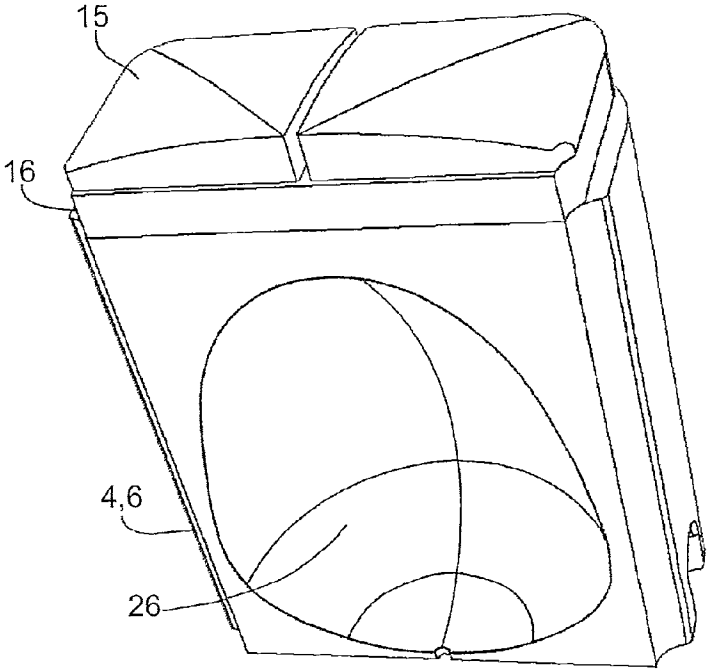
Figure 25:
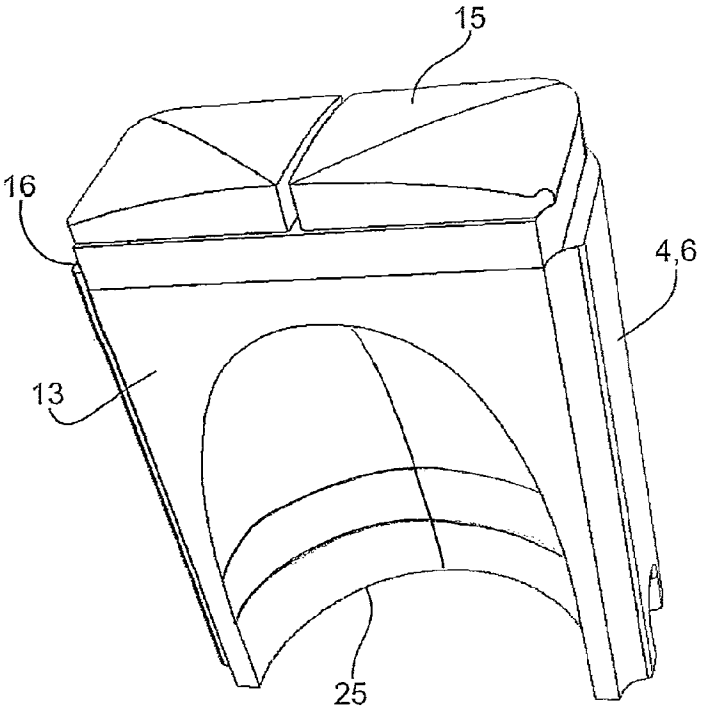

The FIGS. 25, 26 show a further version of the module 4, 6, in which the body 13 has an open cavity 25 (FIG. 25) or a closed cavity 26 (FIG. 26).

In these versions too, the cavities 25, 26 permit a greater deformability of the body 13 to obtain the required elasticity and carrying-capacity characteristics of the module 4, 6. In this case too, the modules 4, 6 of the FIGS. 19-26 and 33-35 can be made in simplified form completely in a single material without a summital part in another material, to be used in the peripheral areas of the supporting element, as in the case of the modules 3 shown in the FIG. 1.

The above body 13 can also comprise compact or expanded materials of the family of thermoplastic elastomer or TPE type, polyurethane or PU type, ethyl vinyl acetate or EVA type, silicone type and similar materials. The FIGS. 27-32 again show other versions of the modules 4, 6 making up the supporting element according to the present invention.

Figure 27:
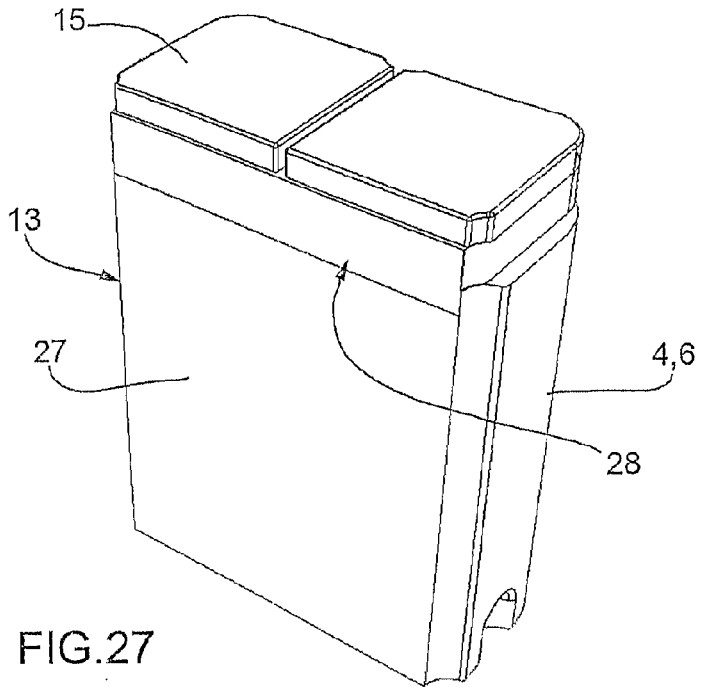

The FIG. 27 shows a transversal section of a module 4, 6 comprising an upper layer 15 in gel, or in any other material suitable for supporting a user, and a body 13 which in turn comprises a lower portion 27 in flexible foam and an upper portion 28 in different-density foam, e.g., viscoelastic foam.

Figure 28:
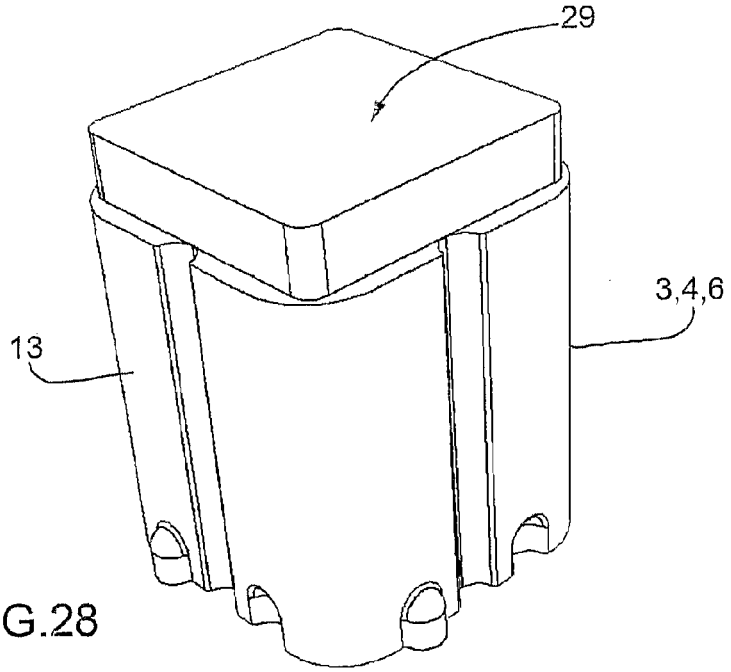

The FIG. 28 shows a simplified version of a module 3, 4, 6 comprising the body 13 in flexible foam, or similar material, and an upper layer 29 in different-density foam, e.g., in viscoelastic foam.

Figure 29:
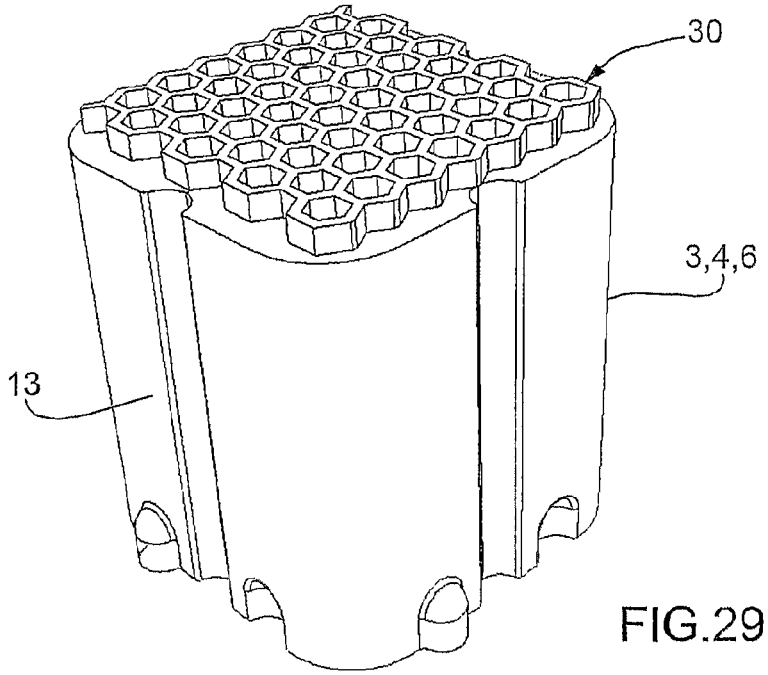

FIG. 29 shows another simplified version of a module 3, 4, 6 comprising the body 13 in flexible foam, or similar material, and an upper layer 30, similar to that of the module of the FIGS. 23 and 24, comprising a honeycomb structure, made for example with a gel, or with other adequate material, e.g., in TPE (Thermoplastic elastomers).

Figure 30:
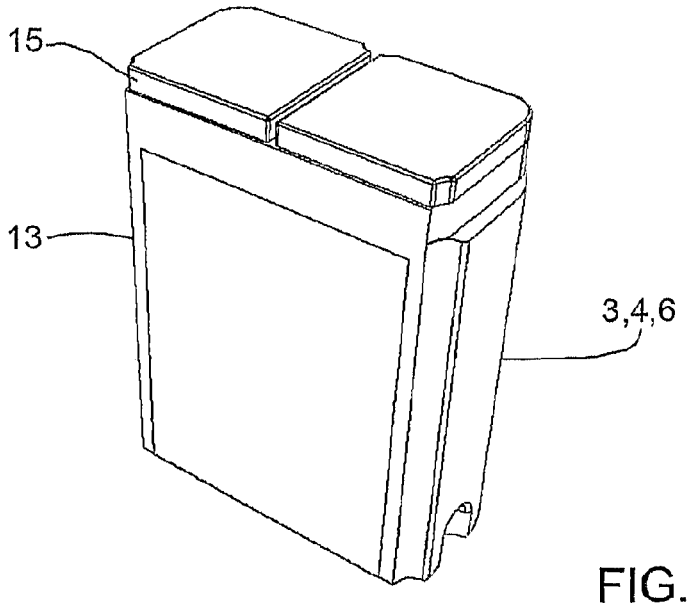
Figure 31:
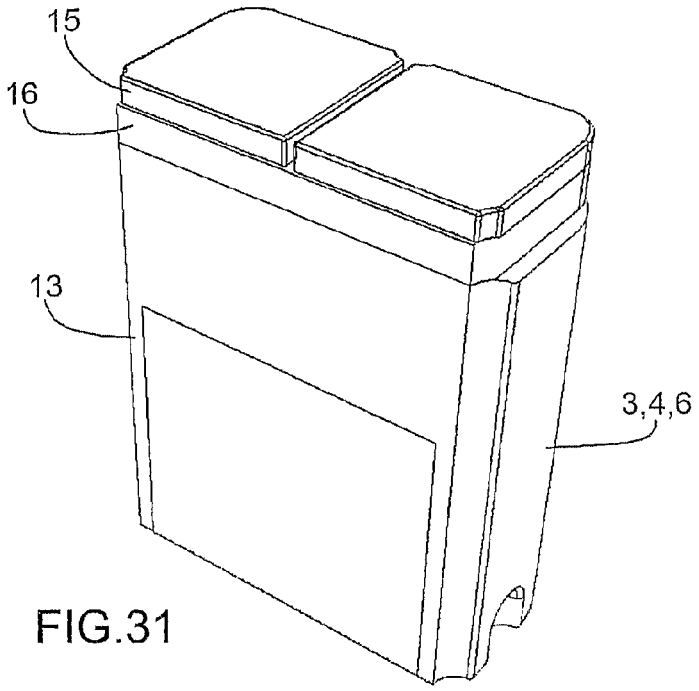
Figure 32:
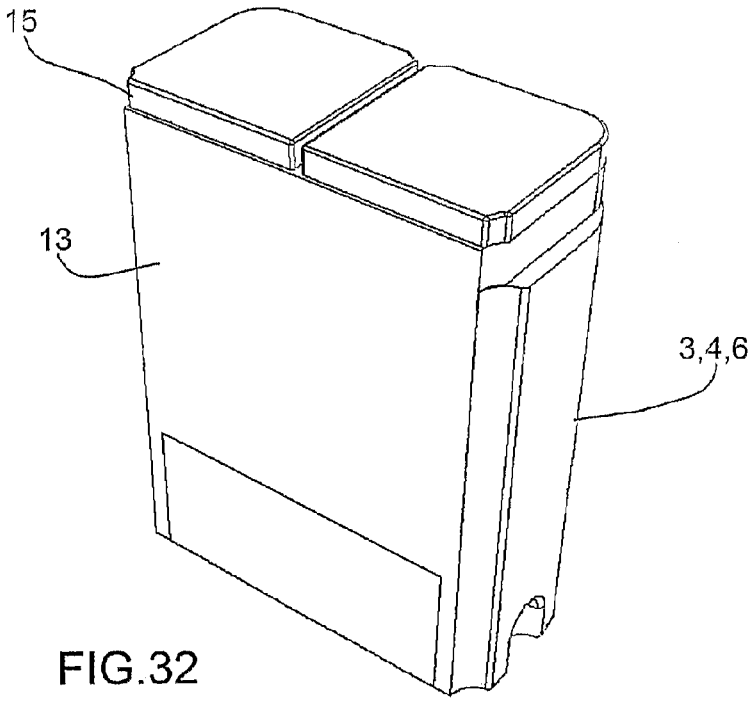
Figure 33:
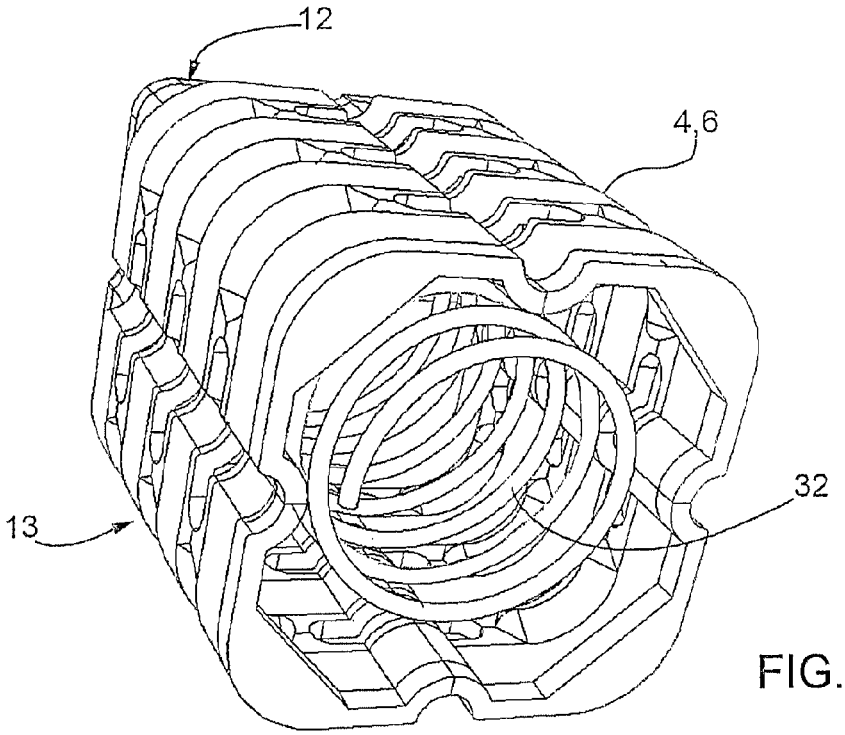
Figure 34:
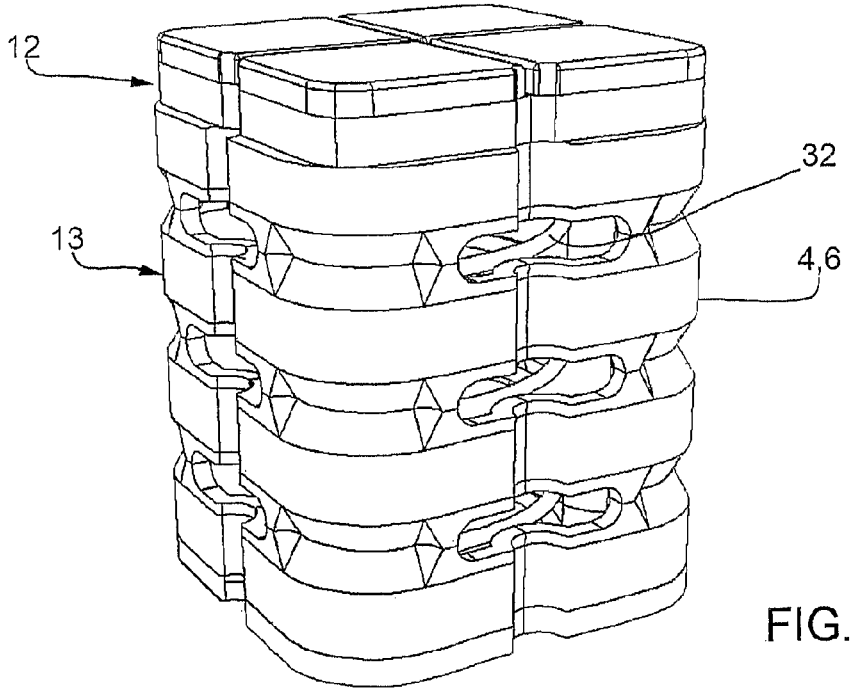
Figure 35:
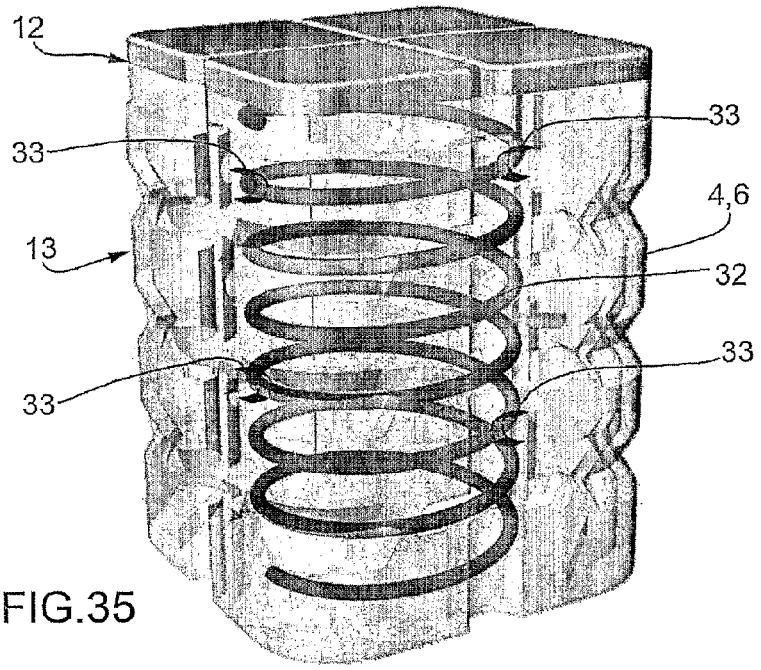

The FIGS. 30-32 show still other versions of a module 3, 4, 6 comprising the body 13 in flexible foam, an upper layer 15 that can be made in different-density foam, e.g., in viscoelastic foam, or with a gel, etc., and a possible intermediate layer 16—shown by way of example only in the FIG. 31 in different-density foam, e.g., in viscoelastic foam. Inside the body 13 is also present another block of different-density foam, e.g., in viscoelastic foam, contained inside the body 13 itself, which can have different shapes and sizes, and in particular can have different heights according to what is shown in the FIGS. 30-32.

In general, the modules 3, 4, 6 according to the present invention can attain different degrees of elasticity and/or deformability by means of the use of different foams, with different shapes and sizes and/or with surface geometries and/or different inner recesses or cavities.

Figure 9:
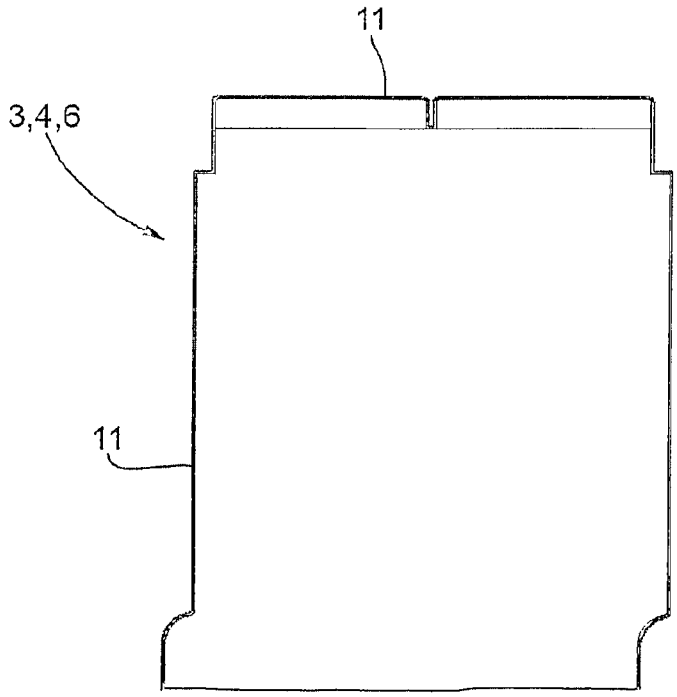
FIGS. 9, 10 and 11 show three versions of modules with sections taken according to the plane S shown in the previous figure.
Figure 10:
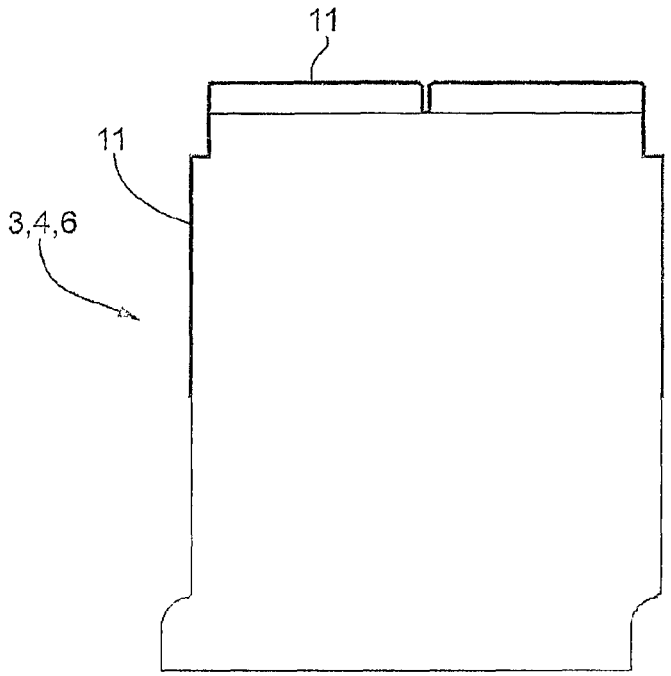

In the event of the upper part of the modules being covered as shown in the FIGS. 9 and 10, the modules are also washable and hypoallergenic, in particular using a polyurethane thermoplastic elastomer film (code TPU).

Figure 11:
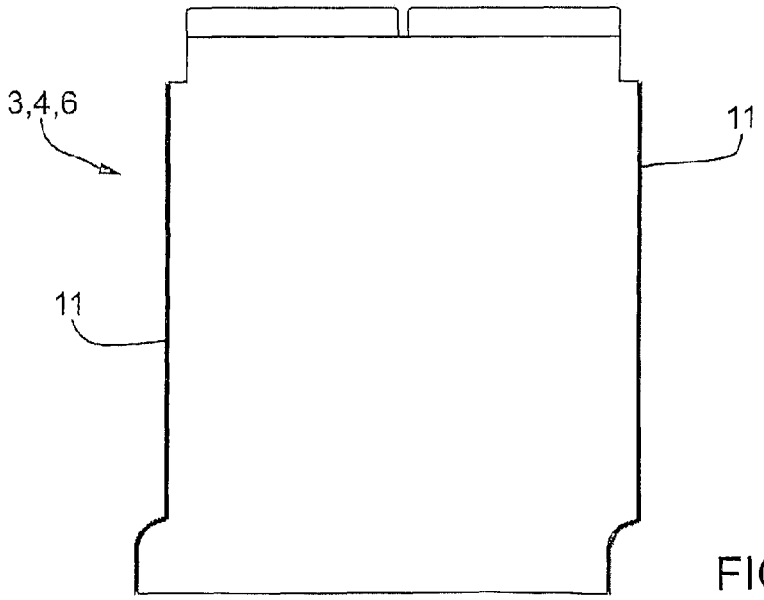

The above film, shown in the FIGS. 9-11, can be overmolded with the polyurethane foam of the module 3, 4, 6 or can be cohesive with the module in any other way, e.g., by gluing, etc.

By making a monolithic module with particular geometries determined by the mold, the vertical and/or horizontal aeration channels 14, 20 can be obtained which give rise to a high degree of air circulation and consequently to a high degree of climatic comfort, without negatively affecting the ergonomic comfort achieved with area by area modularity.

The invention is easy to transport and assemble and the single elements could also be replaced over time in the event of the user changing the postural layout.

The final structure is determined by the stability which the single modules achieve when they are unified inside a containment hood 17 (FIGS. 1 and 2), a unification mesh can also be provided (not shown), without hindering the deformability and the flexibility of the single module. According to a further version of the invention, the above unification mesh comprises intermediate surfaces in which the modules are inserted, such intermediate surfaces also having an anti-friction function between one module and another. Consequently, in this case, the antifriction means are not cohesive with the modules, and in particular, they are not cohesive with the side surfaces of the modules.

The containment hood 17 is made with the common materials used to manufacture the mattresses, e.g., quilted fabrics, with filling in fiber, or foam, or other filling materials, three-dimensional fabrics, single fabrics, both of a man-made and natural type, the foam and the gel are made with polyurethane and can also contain natural material processing derivates.

The gel can have a density, or weight per unit of volume, between 0.4 and 1.5 g/cm$^3$. The foam and the gel can contain solid additives in granules or fibers, commonly used in the polyurethane field, such as, for example, cork, coconut, hollow or solid plastic or glass balls, or other natural or man-made material processing derivates.

This invention has been described according to preferred embodiments, but equivalent variations can be conceived without exiting from the protection scope offered by the following

The invention claimed is:

1. A modular supporting element having a supporting surface for a user, comprising a plurality of elastic modules suitable for being deformed according to a direction substantially perpendicular to the supporting surface of the user, each module having four side surfaces and an upper portion, wherein said modules are arranged juxtaposed to each other with the side surfaces substantially in contact or with the side surfaces at such a distance as not to prevent contact between one module and another during the elastic deformation movement, wherein the modules comprise anti-friction means arranged in a part of the side surface of the modules in such a way as to prevent interferences by friction between one module and another, and wherein said modular supporting element is made up of a plurality of modules with different rigidity from area to area without any appreciable influence between one module and another, and wherein each module includes at least one vertical channel formed in each of said four side surfaces.

2. The modular supporting element according to the claim 1, in which the modules have the shape of a prism or a parallelepiped, so as to be able to be juxtaposed the one with the other without substantially forming empty spaces, or forming empty spaces such as not to prevent contact during the elastic deformation movement, between the side surfaces of one module and another.

3. The modular supporting element according to the claim 1, in which the modules comprise anti-friction means arranged on a part of the side surface and on the upper portion.

4. The modular supporting element according to claim 1, in which the modules have a height dimension substantially the same as that of the supporting element itself.

5. The modular supporting element according to claim 1, in which the modules comprise anti-friction means arranged on all the side surfaces and on the upper portion.

6. The modular supporting element according to claim 1, comprising unification means suitable for keeping the modules juxtaposed the one to the other.

7. The modular supporting element according to the claim 6, in which the unification means comprises a containment hood.

8. The modular supporting element according to the claim 6, in which the unification means comprises anti-friction means.

9. The modular supporting element according to the claim 8, in which said anti-friction means comprises horizontal-wall meshes of the grille type or with vertical walls of the pigeon-hole type.

10. The modular supporting element according to claim 6, in which the unification means comprise plates, that can be made of plastic or fabric.

11. The modular supporting element according to claim 6, in which said unification means-comprises fastening means suitable for fastening the modules-juxtaposed the one with the other.

12. The modular supporting element according to claim 11, in which said fastening means comprises at least one peg suitable for fitting in respective housings provided in the modules.

13. The modular supporting element according to the claim 11, in which said fastening means are integrated in a containment hood.

14. The modular supporting element according to the claim 13, in which said fastening means comprises at least one peg suitable for fitting in respective housings provided in the modules.

15. The modular supporting element according to claim 1, in which the modules comprises complementary geometry means that determine a self-assembly of the modules themselves.

16. The modular supporting element according to the claim 15, in which said complementary geometry means comprises complementary protrusions and recesses.

17. The modular supporting element according to claim 1, in which the modules comprise single-density or multi-density material, including materials in viscoelastic foam and flexible foam, or gel and flexible foam, or honeycomb gel and flexible foam, or different-density flexible foams, or a combination of the materials.

18. The modular supporting element according to claim 1, in which said anti-friction means comprise films, fabrics, non-woven fabrics, coating, or self-skin foam materials.

19. The modular supporting element according to the claim 18, in which said anti-friction means comprises one or more materials including ethyl vinyl acetate (EVA), foam EVA, silicone, or thermoplastic elastomer.

20. The modular supporting element according to claim 1, wherein the modules further comprise horizontal channels.

21. The modular supporting element according to claim 20, in which each vertical channel connects with the horizontal channel.

22. The modular supporting element according to the claim 20, in which said modules comprise a summital part and a lower body, wherein the summital part comprises a smaller surface compared to the lower body, to form said horizontal channels on a surface in contact with the user.

23. The modular supporting element according to claim 1, in which the modules comprise two summital parts suitable for being in contact with the user thereby making supporting elements with two opposite surfaces of use.

24. The modular supporting element according to claim 1, in which the modules comprise an upper layer in gel, an intermediate layer in viscoelastic foam and a body in flexible foam.

25. The modular supporting element according to claim 22, in which the modules comprise, at least in the summital part, a protective washable and hypoallergenic film, in particular a film of polyurethane thermoplastic elastomer (TPU).

26. (Withdrawn- Previously amended) The modular supporting element according to the claim 25, in which said protective washable and hypo-allergenic film is overmolded with the polyurethane foam of the modules or is cohesive with the module.

27. The modular supporting element according to claim 1, in which the modules comprise at least a part in mold or block polyurethane foam, with compression resistance values at 40% included between 0.5-10 kPa, such values being measured according to the ISO 3386 standard.

28. The modular supporting element according to claim 1, in which the modules-comprise a body having open or closed cavities.

29. The modular supporting element according to the claim 28, in which said body comprises compact or expanded materials of a family of the thermoplastic elastomer or TPE type, polyurethane or PU type, ethyl vinyl acetate or EVA type, silicone type.

30. The modular supporting element according to claim 1, in which said modules comprise a body having at least an inner open or closed cavity, and/or openings, and/or grooves.

31. The modular supporting element according to the claim 30, in which said body, having at least an inner open or closed cavity, comprises at least a spring.

32. The modular supporting element according to the claim 31, in which said spring is connected to the body by means of connection means which permits a joint deformation movement between the body and the spring.

33. The modular supporting element according to the claim 31, in which said spring is completely or partially drowned in the material of the body.

34. The modular supporting element according to claim 1, in which said modules have a height substantially equal to 100% the thickness of the supporting element itself.

35. A modular supporting element having a supporting surface for a user, comprising a plurality of elastic modules deformable in a direction substantially perpendicular to the supporting surface of the user, each module comprising four exterior side surfaces and an upper portion, wherein said modules are arranged juxtaposed to each other with the exterior side surfaces substantially in contact, wherein the modules comprise anti-friction means arranged in a part of the exterior side surface of the modules in such a way as to prevent interference by friction between the modules, wherein the plurality of modules further comprise horizontal channels and each module includes at least one vertical channel formed in each of said four exterior side surfaces that connects with at least one of the horizontal channels.

* * * * *